United States Patent [19]

Newton

[11] 4,093,076

[45] June 6, 1978

[54] BOTTLE RACKS, PARTICULARLY RACKS FOR WINE BOTTLES

[75] Inventor: Brian R. Newton, Johannesburg, South Africa

[73] Assignee: Newton & Taylor (Proprietary) Limited, South Africa

[21] Appl. No.: 541,503

[22] Filed: Jan. 16, 1975

[30] Foreign Application Priority Data

| | | |
|---|---|---|
| Jan. 22, 1974 | South Africa | 74/0450 |
| Sep. 4, 1974 | South Africa | 74/5616 |

[51] Int. Cl.[2] ..... A47B 73/00

[52] U.S. Cl. ..... 211/74; 211/189

[58] Field of Search ..... 211/74, 177, 183, 75, 211/189, 194; 248/68 CB; 312/107, 111; D6/186, 188, 189; D7/71

[56] References Cited

U.S. PATENT DOCUMENTS

| | | | |
|---|---|---|---|
| D. 230,242 | 2/1974 | Bentley | D7/71 |

FOREIGN PATENT DOCUMENTS

| | | | |
|---|---|---|---|
| 1,199,687 | 8/1965 | Germany | 211/74 |
| 1,330,786 | 9/1973 | United Kingdom | 211/74 |
| 1,202,519 | 8/1970 | United Kingdom | 211/74 |
| 1,133,399 | 11/1968 | United Kingdom | 211/74 |

*Primary Examiner*—Lawrence J. Staab

*Attorney, Agent, or Firm*—Ostrolenk, Faber, Gerb & Soffen

[57] ABSTRACT

A bottle rack, particularly a wine bottle rack, comprising a plurality of rack-forming elements interengageable in substantially coplanar relationship to define an apertured panel adapted to receive bottles in the apertures and to support the bottles in generally horizontal disposition on the surrounds of the apertures.

9 Claims, 2 Drawing Figures

BOTTLE RACKS, PARTICULARLY RACKS FOR WINE BOTTLES

This invention relates to bottle racks, particularly racks for wine bottles.

According to the invention a bottle rack includes a plurality of rack-forming elements which are interengageable in substantially co-planar relationship to define an apertured panel adapted to receive bottles in generally horizontal or near horizontal disposition in the apertures and to support the bottles on the surrounds of the apertures.

The rack-forming elements may be of substantial width whereby a single panel formed thereby is capable of supporting bottles in stable manner.

Alternatively, the rack-forming elements may be of a relatively small width, a pair of juxtaposed, transverely spaced panels being provided with their apertures in alignment to support bottles in spaced zones along their lengths. Such a pair of juxtaposed panels may be adapted to be releasably or permanently connected together to form a stable structure.

A rack-forming element may present at least one concave formation adapted to define at least part of a bottle supporting surface.

Preferably the rack-forming element presents four concave formations facing radially outwardly in mutually transverse directions. Preferably also, the centre line of the four concave formations are offset substantially 90° to each other.

The concave formation or formations may have circular, oval, polygonal or any other suitable peripheral configurations.

The rack-forming elements may be of substantially similar shape and size to permit the rack to be of modular construction.

The rack-forming elements are preferably interengageable in such a manner that the rack is extensible in both a vertical and a horizontal direction.

With the arrangement according to the invention a bottle rack may be constructed from any suitable number of interengageable rack-forming elements to provide any required number of concave bottle supporting surfaces. Such a rack may be operatively located in any suitable place and may have relative vertical and horizontal dimensions to suit the place where it is to be located. It will be appreciated that such a rack is very adaptable to suit the particular requirements of the particular user. The ordinary wine drinker would be able to assemble a rack adapted to accommodate a modest number of bottles in an ordinary cupboard or cabinet, whereas a connoisseur would be able to assemble a rack adapted to accommodate a large number of bottles in a cellar.

The bottle rack may include at least one terminal rack-forming element presenting at least one end formation adapted to define a complete bottle supporting surface on its own or to define a complete bottle supporting surface with an adjacent rack-forming element.

The terminal rack-forming element may be designed to give a neat end appearance.

In a preferred embodiment, the terminal element is of substantial width and adapted to span the space between a pair of juxtaposed, transversely spaced panels formed from rack-forming elements of relatively small width, the terminal element being interengageable towards opposite ends thereof with rack-forming elements of the two panels. Such a terminal element may serve to connect the two juxtaposed panels together.

The terminal rack-forming element may be adapted to be located on a lateral end of the apertured panel or panels and to present at least part of a lateral end bottle supporting formation. Such a lateral end bottle supporting formation may comprise a horizontally facing, semicircular concavity.

The terminal rack-forming element may be substantially co-extensive vertically with an inner rack forming element with which it is interengageable. This is advantageous for a modular construction of the rack.

Alternatively, the terminal rack-forming element is adapted to form at least part of a base for the apertured panel or panels.

Such a base terminal element may be substantially co-extensive horizontally with an inner rack-forming element with which it is interengageable. This is also advantageous for a modular construction of the rack.

Any suitable interengageable formations, such as complementary dove-tailed or like formations may be provided on the elements.

The interengagement of a plurality of elements forming an apertured panel is preferably such that they cannot be disengaged by relative movement in the plane of the panel, but only in a direction transversely to the panel.

The invention includes within its scope a rack-forming element as defined above.

A preferred embodiment of the invention will now be described by way of example with reference to the accompanying drawings in which.

Figure 1:
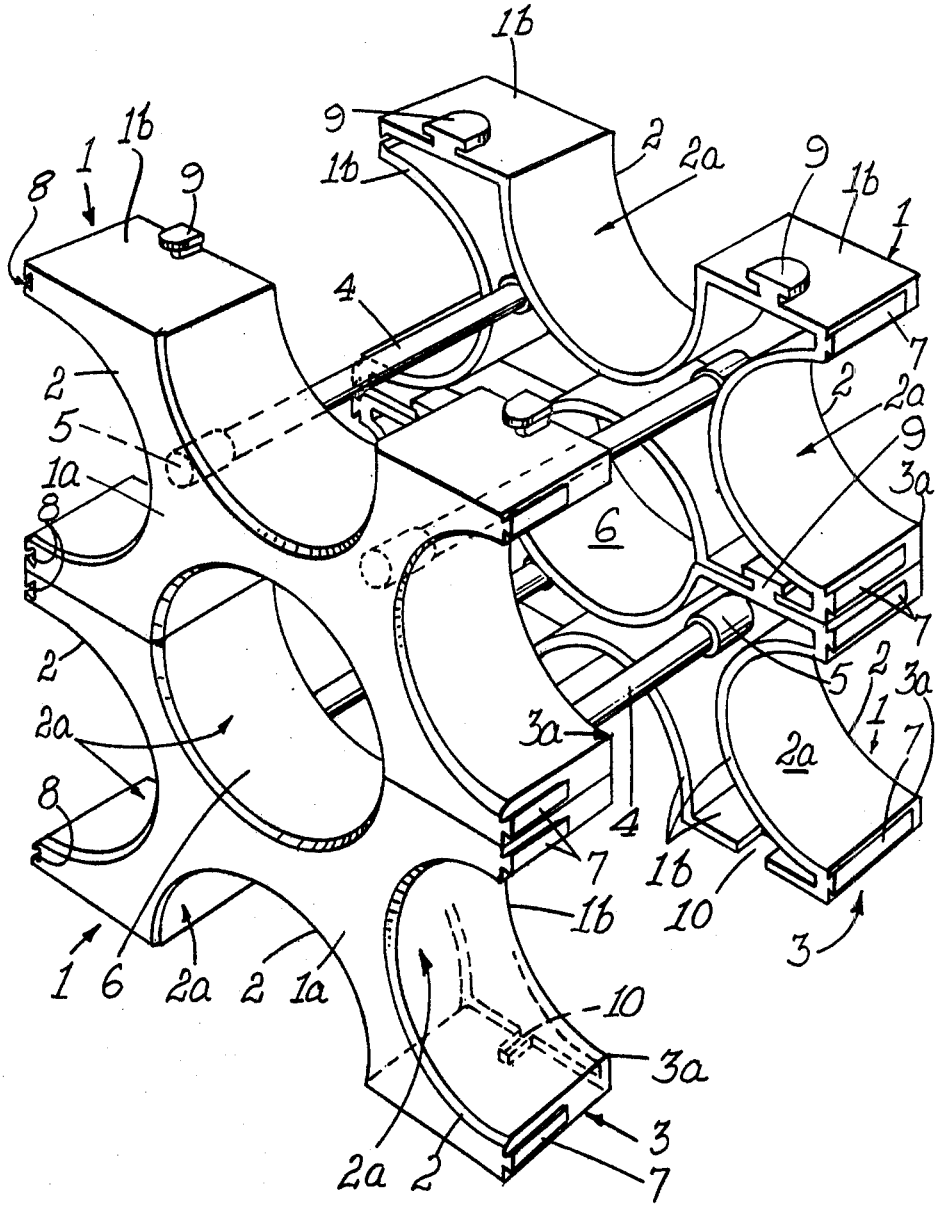
FIG. 1 is a perspective view of part of a bottle rack according to the invention, comprising a pair of juxtaposed, transversely spaced apertured panels.

As shown in FIG. 1, the bottle rack is built up from a plurality of interengageable rack-forming elements 1 which are all of substantially the same shape and size to permit a modular construction. Each rack-forming element 1 comprises a front plate 1*a* and a rearwardly extending peripheral flange 1*b* to present a hollow back. Each element 1 has a generally rectangular perimeter in face view with a circular concavity 2 in each side of the rectangle to present four radially outwardly facing concave formations 2 whose centre lines are off-set 90° to each other. Each concave formation 2 is adapted to define a bottle supporting surface 2*a* or part thereof.

Two sets of rack-forming elements 1 are interengageable in co-planar relationship to define a pair of juxtaposed, transversely spaced apertured panels 3, each pair of adjacent elements 1 in a panel defining a circular bottle receiving aperture 6. Collectively, the elements 1 of each panel 3 define a plurality of generally horizontal or near horizontal concave bottle supporting surfaces 2*a* at the lower portions of the surrounds of apertures 6. The two panels 3 are interconnected by spigots 4 which are engaged in socket formations 5 which are fast with and extend inwardly from the two panels. Spigots 4 may be secured in socket formations 5 by means of an adhesive in order to secure the two panels together. The apertures 6 of the two panels 3 are aligned in a horizontal direction and each pair of aligned apertures 6 in the two panels 3 are adapted to receive a bottle and to support it in spaced zones along its length in a horizontal or near horizontal disposition on support surfaces 2*a* at the lower portions of the surrounds of the apertures 6.

Each panel 3 comprises a plurality of horizontal rows 3*a* of elements 1, successive rows 3*a* being located one on top of the other with the concave formations 2 of successive rows in vertical alignment. Adjacent elements 1 in a row 3*a* are interengaged with each other by means of complementary dove-tail formations 7, 8 which are interengageable by relative movement of the elements in a direction transversely to the plane of the panel 3. Dove-tail formations 7, 8 prevent disengagement of adjacent elements 1 in a row 3*a* in a horizontal direction longitudinally along rows, as well as in a vertical direction transversely to the row. Elements 1 of each successive row 3*a* are interengaged with elements 1 of the immediately preceding row 3*a* by means of flanged lugs 9 on the upper surfaces of the upper flanges 1*b* of each element 1 of each row, which are locatable in slots 10 in the lower flanges 1*b* of each element of the next row to prevent disengagement of the elements 1 of adjacent rows 3*a* in a horizontal direction longitudinally along the rows in the plane of the panel 3. The flanges on lugs 9 on the upper flanges 1*b* of the elements 1 of each row engage the surrounds of the slots 10 in the lower flanges 1*b* of the elements 1 of the next successive row to prevent disengagement of the elements 1 of adjacent rows 3*a* in a vertical direction transversely to the rows.

It will be clear from the foregoing that the interconnection of the elements 1 in a panel 3 are such that adjacent elements are interengageable and disengageable by relative movement of the elements transversely to the panel and cannot be disengaged by relative movement of adjacent elements in the plane of the panel.

Each row 3*a* in each panel 3 may include any required number of elements 1 and any required number of rows 3*a* may be provided on top of one another to provide a bottle rack having any required length and height and bottle supporting capacity.

It will be apparent from FIG. 1 that when a plurality of rack-forming elements 1 are interengaged to form a bottle rack, the elements 1 on the end of each panel 3 present outwardly facing concave formations 2 which do not form complete bottle supporting surfaces when the rack is in operative position.

Figure 2:
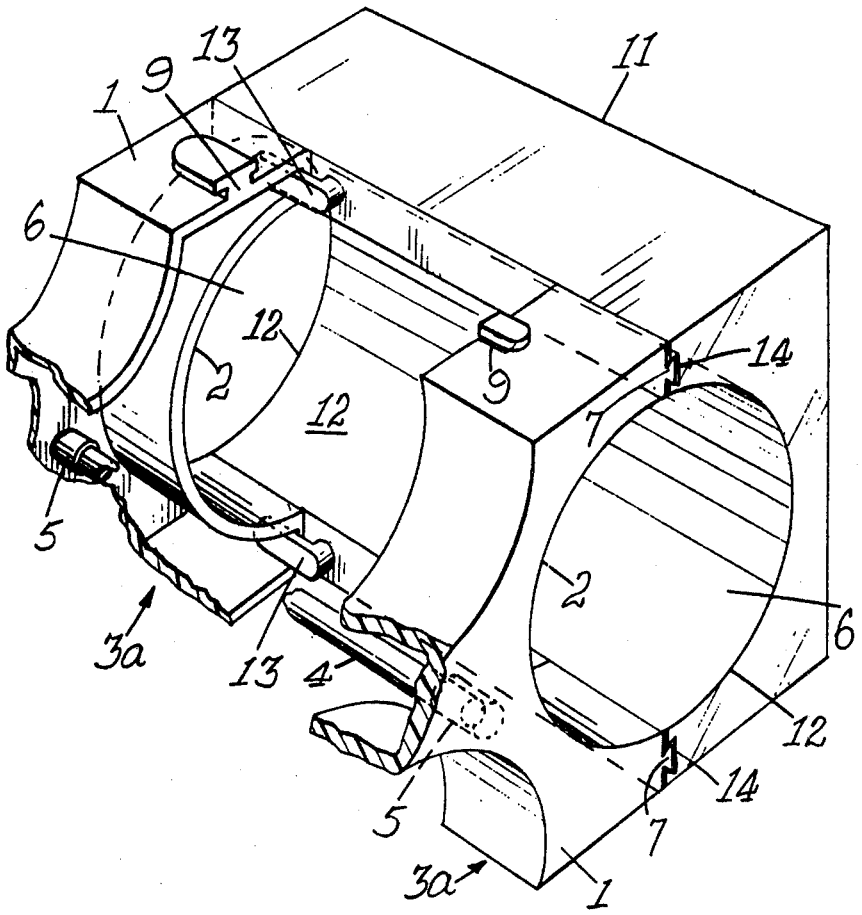
FIG. 2 is a perspective view of a lateral terminal rack-forming element on the ends of a pair of juxtaposed, transversely spaced apertured panels.

In order to complete the rack, a lateral terminal rack-forming element 11 which spans the space between the two panels 3, may be provided for a pair of horizontally aligned rows 3*a* of elements 1 in the two panels as shown in FIG. 2. Terminal element 11 is interengageable towards opposite ends with adjacent elements 1 at the ends of the aligned rows 3*a* and extends from the outer face of the one panel 3 to the outer face of the other panel 3 to provide flush outer face configurations.

It will be seen that terminal element 11 is co-extensive vertically with the adjacent elements 1 with which it is interengageable. Terminal element 11 presents a horizontally semi-circular concave formation 12 to form complete circular bottle receiving apertures 6 in conjunction with the horizontally outwardly facing concave formations 2 of the adjacent elements 1 of the two panels 3, thereby permitting the horizontally outwardly facing concave formations 2 at the ends of the aligned rows 3*a* to be utilised for the support of bottles.

Terminal element 11 is connected to adjacent element 1 by means of catch formations 13 on terminal element 11 which are adapted to engage behind co-operating end walls or end flanges on the outer ends of elements 1. It will be seen that terminal element 11 includes longitudinal grooves 14 in its inwardly directed faces, grooves 14 being adapted to accommodate the dove-tailed projections 7 on the outer ends of adjacent elements 1.

Terminal element 11 serves to connect the two apertured panels 3 together at their ends in order to give a rigid structure. By providing a lateral terminal rack-forming element 11 for each pair of horizontally aligned rows of elements 1, all the lateral end concave bottle supporting surfaces may be utilised for the support of bottles. Also, a neat end appearance can be obtained. Since each lateral terminal element 11 is vertically co-extensive with the adjacent elements 1 with which it is interengaged, a modular construction is possible.

It will be appreciated that many variations in detail are possible without departing from the scope of the appended claims. Thus, apertures 6 in panels 3 may have any suitable cross-sectional configuration other than circular, such as oval or polygonal. Also, the elements 1 may have perimeters other than rectangular in face view and an element 1 may have any suitable number of concavities 2 other than four.

By using one standard shape of element 1, production costs can be minimised and any size of rack constructed from a suitable number of elements of the same shape, but it is not inconceivable that the design may be such that a rack may be constructed from two or more standard shapes of elements.

Instead of lateral terminal element 11 being adpated to be associated with only one pair of horizontally aligned rows of elements 1 as shown in FIG. 2, it may be adapted to be associated with two or more pairs of horizontal rows. With such an arrangement, terminal element 11 may present a plurality of horizontally inwardly facing concave formations 12 one above the other.

It is also possible for terminal element 11 to present a complete end aperture (not shown) of circular configuration and located horizontally outwardly of semi-circular formation 12. Terminal element 11 will then define a complete bottle supporting surface on its own and also a complete bottle supporting surface in conjunction with adjacent rack-forming elements 1.

Instead of terminal element 11 being of substantial width so that it extends between the two apertured panels 3 as shown in FIG. 2 of the drawings, it may have the same width as each of the elements 1. With such an arrangement, each end element 1 may be interengaged with its own lateral terminal element 11. Such terminal elements 11 will not extend between the two panels 3.

A bottle rack as illustrated in FIG. 1, with or without one or more lateral terminal elements 11 as shown in FIG. 2, may be adapted to be supported on a supporting surface by the lower flanges 1*b* of the lower rows 3*a* of elements 1. Alternatively, one or more base terminal elements may be provided underneath and in contact with the lower flanges 1*b* of the lower rows 3*a*, such a base terminal element presenting one or a plurality of horizontally spaced bottom end bottle supporting formations. Such bottom end bottle supporting formations may comprise one or more upwardly facing, semi-circular concavities adapted to mate with the down-wardly facing concavities 2 in the elements of the lower rows 3*a*.

The rack-forming elements may be made from polymer or any other suitable material. Preferably, each element is integrally moulded from polymer material.

I claim:

1. A rack for bottles, or the like, comprising:

a plurality of basic rack forming elements arranged in two spaced apart substantially coplanar sets; each of said basic elements having a periphery defined by edges; at least one concave formation defined in a said edge, thereby to define at least part of a supporting surface for a bottle, or the like;

said basic elements of said sets thereof are oriented and positioned such that each concave formation defined in the basic elements making up one of said sets is generally aligned with a concave formation defined in the basic elements making up the other of said sets, thereby to provide and define at least part of two cooperating supporting surfaces for support of a bottle, or the like, that extends between two aligned said formations on the two said sets;

means for joining said sets of basic elements and for supporting them in their said orientations;

the edges of the outermost basic elements of each set defining the free edge portions of the sets said free edge portions being aligned;

a terminal rack forming element extending between said sets at a free edge portion thereof; said terminal element being in engagement with a said aligned free edge portion of both said sets; thereby closing off said free edge portion of both said sets and to close off the space between said sets.

2. The rack of claim 1, wherein the said concave formation of the said basic element at said free edge portion is positioned on its said basic element to face outwardly toward the adjacent said terminal element, that said terminal element having an edge that faces toward the adjacent said basic element, and on that said edge of said terminal element is a formation which cooperates with said basic element concave formation to together define a completed surface on which a bottle, or the like, may be supported.

3. The rack of claim 2, wherein each said set of basic elements comprises a plurality of said basic elements arranged generally coplanarly; engagement means between adjacent said basic elements for holding them together;

each said basic element having a generally rectangular shape in the plane thereof; in each of said four edges of each said basic element is defined a respective said concave formation which opens outwardly of the respective said edge; each said concave formation on a said basic element having a respective center line that is offset substantially 90° from the center line of the adjacent said concave formations on that said basic element.

4. The rack of claim 3, wherein said engagement means between adjacent said basic elements comprises cooperating engageable elements on each said edge of each said basic element; said engageable elements being located on both sides of each said concave formation on each said side of said basic element.

5. The rack of claim 2, wherein said terminal element formation comprises a second concave formation which cooperates with and is a continuation of its respective said basic element concave formation; each said second concave formation extending the length of its said terminal element to and past the respective said aligned concave formations on both said basic element sets with which that said terminal element is in engagement.

6. The rack of claim 5, wherein said terminal element is generally rectangular in cross-section along the plane of a said set, and said second concave formation is defined along one side of the rectangular said terminal element.

7. The rack of claim 2, wherein each said set of basic elements comprises a plurality of said basic elements arranged generally coplanarly, and engagement means being located between adjacent said basic elements for holding them together;

said basic elements in each said set being vertically stacked, such that the end most basic elements of each horizontal row thereof in a stack each has a said aligned free edge portion; a respective said terminal rack forming element being provided for each said endmost basic element of each said horizontal row of said basic elements and being in engagement therewith.

8. The rack of claim 7, wherein said free end edge portion of each said basic element has a predetermined height; the respective said terminal element that is in engagement with a said basic element free edge portion having said predetermined height.

9. In combination, a rack forming element adpatable for forming a rack with other said rack forming elements and a rack forming terminal element;

said rack forming element comprising:

a generally planar element with corners and having four sides; substantially identical generally semicircular formations which open outwardly being generally centrally located along each said side of said element; each said formation having a center line; said formation center lines of adjacent said formation being offset substantially 90° to each other;

on each said element side, spaced from each said formation in both directions, is an engageable securement means which is adapted to cooperate with a mating engageable securement means on another object; and, said rack forming terminal element having four relatively long length sides; centrally located along one said side of said terminal element and extending the full length thereof is a second concave formation which opens outwardly of that one said side; spaced from said second formation in both directions and on said one element side are located engageable means adapted to cooperate with mating engageable means on another object;

said engageable means on one said side of said rack forming element being shaped and located to engage with and being in mating engagement with said engageable means on said rack forming terminal element one said side; said generally semicircular formation on said rack forming element and said second concave formation on said terminal element being so placed and oriented that with said engageable means engaged, such formations define a generally circular opening.

* * * * *